United States Patent [19]

Sullivan, III

[11] Patent Number: 4,979,751

[45] Date of Patent: Dec. 25, 1990

[54] LIGHTED FOOTBALL STRAP

[75] Inventor: Earl W. Sullivan, III, 624 56th St., West Palm Beach, Fla. 33407

[73] Assignee: Earl W. Sullivan, III, West Palm Beach, Fla.

[21] Appl. No.: 429,656

[22] Filed: Oct. 31, 1989

[51] Int. Cl.[5] ..... A63B 43/06

[52] U.S. Cl. ..... 273/317; 273/58 G; 273/58 K; 273/65 R; 273/DIG. 24

[58] Field of Search ..... 273/317, 58 R, 58 G, 273/58 H, 58 K, DIG. 24, 65 R, 65 EG

[56] References Cited

U.S. PATENT DOCUMENTS

| | | | |
|---|---|---|---|
| 2,011,760 | 8/1935 | Gallinant | 273/65 EG |
| 3,539,794 | 11/1970 | Rauhut et al. | 273/DIG. 24 |
| 3,597,362 | 8/1971 | Bollyky et al. | 560/139 X |
| 4,002,893 | 1/1977 | Newcomb et al. | 273/58 G X |
| 4,086,723 | 5/1978 | Strawick | 273/DIG. 24 |
| 4,479,649 | 10/1984 | Newcomb et al. | 273/DIG. 24 X |
| 4,776,589 | 10/1988 | Yang | 273/58 G |

*Primary Examiner*—William H. Grieb

[57] ABSTRACT

A harness is disclosed for the attachment of one or more Chemi-luminescent light sticks to the outside of a play-piece. Such as a football, vollyball, basketball, whiffleball etc. The harness has one or more open-ended sections in-which the light sticks can be easily inserted or removed by hand. The sections can be transparent or translucent plastic base, to house the lights, which in one embodiment are tubular chemical lights which are activated by bending, snapping and shaking. In one embodiment the harness may include quick release attachment means to facilitate use.

8 Claims, 5 Drawing Sheets

LIGHTED FOOTBALL STRAP

BRIEF SUMMARY OF THE INVENTION

One preferred embodiment of the harness claimed there-of is designed to hold two Chemi-luminescent light sticks around an official size football, conventional foam football, official size volley ball, whiffle ball, etc. When the light sticks are activated and inserted into the tubular section, the harness can be easily adjusted around said ball for night time play. The result of the illuminated light effect that the harness has around said ball, is unlike other patented play balls. To the best of my knowledge other play balls have their light source on the inside surface, enabling the entire ball to light up. The harness approach however, holds Chemi-luminescent light sticks snugly around the out side of any one preferred ball. When the ball is thrown in a spinning or spiraling motion, one see's the effect of a bright illuminated beam of light.

DETAILED DESCRIPTION OF ONE PREFERRED EMBODIMENT

The lighted football strap consists of two transparent tubular sections, six pieces of bright flourescent colored rubber, and eight rivets, constructed together to form a one piece harness.

Figure 1:
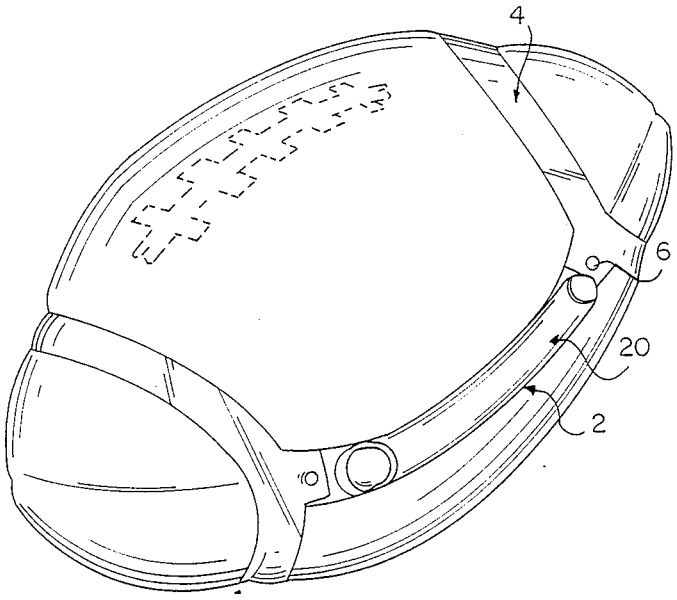
FIG. 1 PRIOR ART
FIG. 1 is a perspective view of a harness around a foam football. Using two transparent tubular sections.
Figure 3:
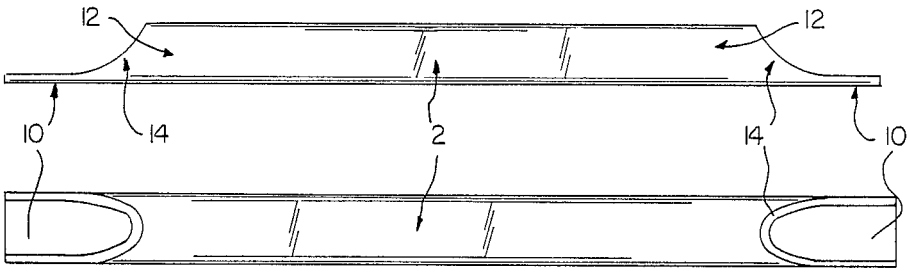
FIG. 3 shows a side and top perspective view of a transparent tubular section.
Figure 4:
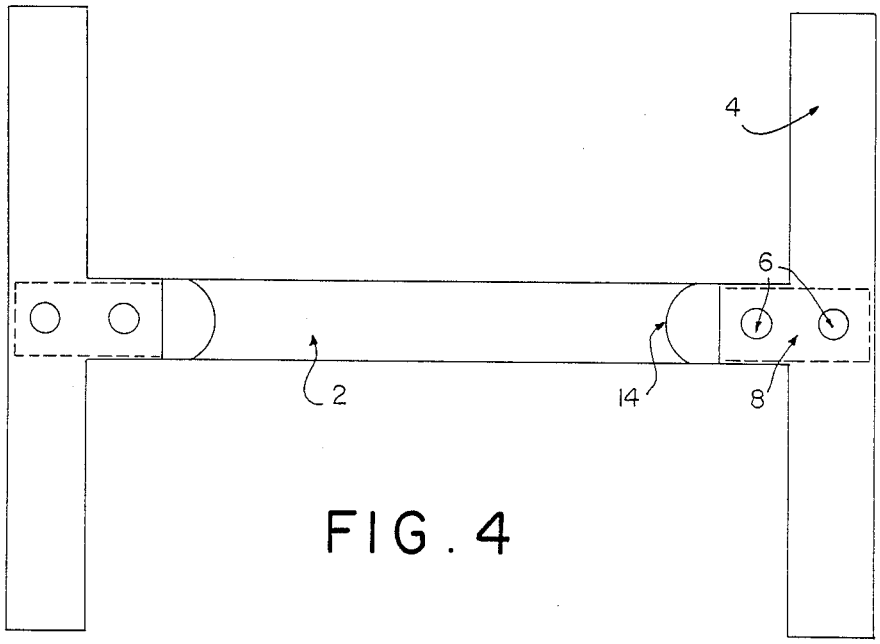
FIG. 4 shows a top perspective view of the harness.
Figure 5:
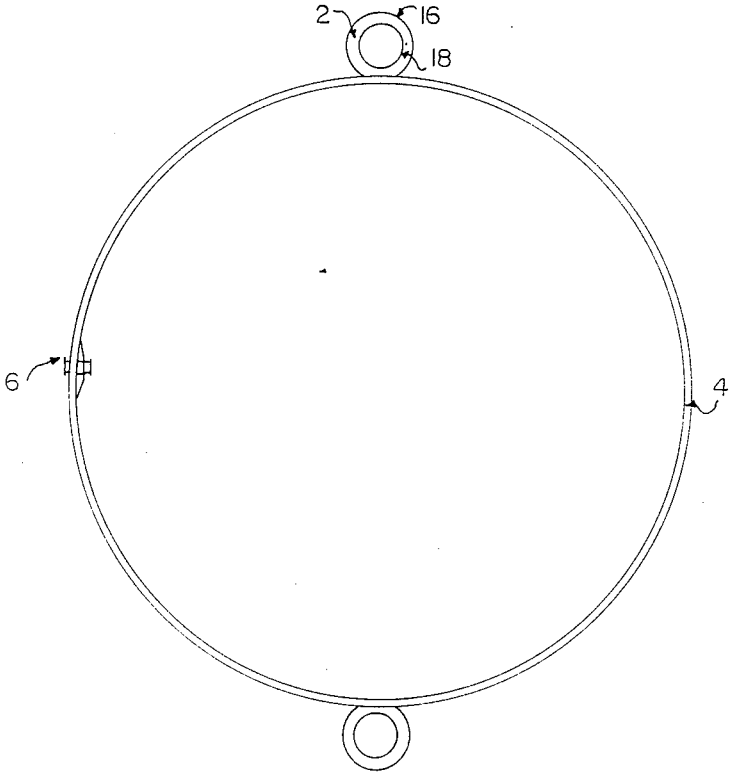
FIG. 5 is a front perspective view of the harness.
Figure 6:
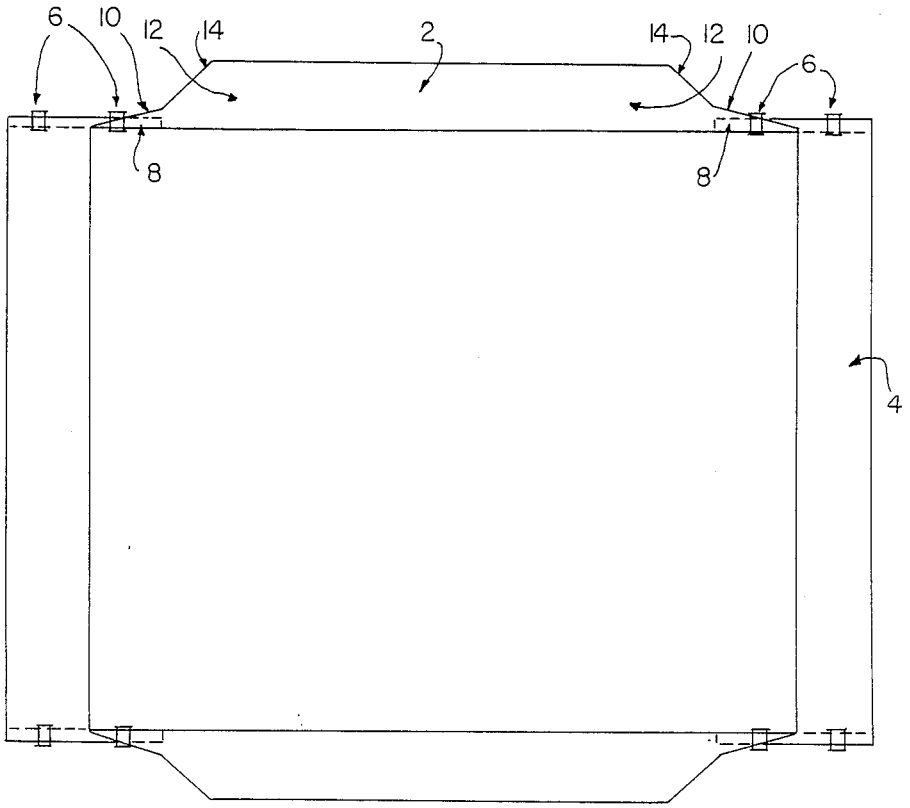
FIG. 6 is a side perspective view of the harness.
Figure 7:
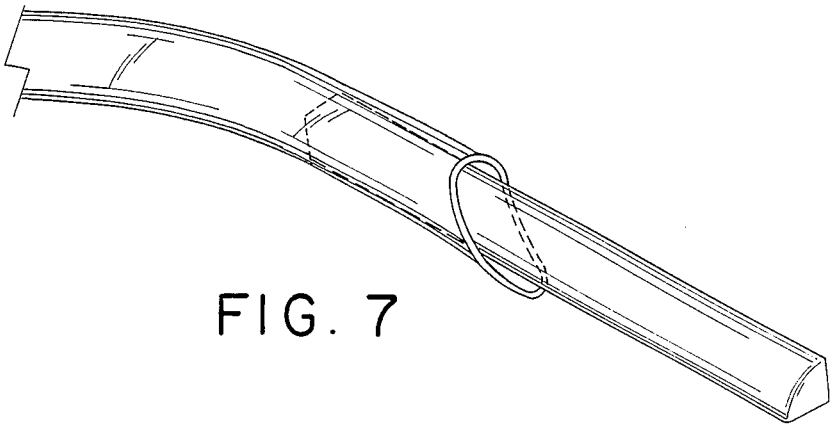
FIG. 7 is an enlarged perspective view of a Chemi-luminescent light stick inserted partialy through the opening of a transparent tubular section.

The said tubular sections 2 are manufactured out of 0.437 flexible transparent tubing (FIG. 5)-16 with an inner diameter of 0.330 18. The length of onesaid tubular section is 4.500 (FIG. 3)-2 and is 1.500 longer than one Chemi-luminescent light stick, allowing 0.750 on both sides of said tubular section, for a fastening tab 10. The said fastening tabs are formed by a 45° obligue cut 0.750 in from one end of said tubular section 14, but not cutting more than 0.666 down said tubular section, leaving a 0.500 square end fastening tab 10. The said 45° obligue cut 14 at both ends of said tubular section, allows a substancial amount of pulling pressure for said fastening tabs 10 securing them from ripping apart, and allowing an entrance at both ends of said tubular section for the insertion of a Chemi-luminescent light stick (FIGS. 3 and 6)12. The remaining part of the harness is constructed by two 0.500×14.000 (FIG. 4–5 and 6)4 and four 0.500×1.000 8 pieces of said bright flourescent colored rubber. Both 14.000 pieces of said rubber are over lapped from end to end, 0.500 and are pop riveted (FIG. 5)-6 to form two 360° circles (FIG. 5)-4. Two 1.000 pieces (FIG. 4)-8 of said rubber are pop riveted on opposite sides of said 360° circles (FIG. 6)-6. The fastening tabs of said tubular sections 10 are pop riveted to the other end of said 1.000 inch pieces of said rubber, 6 forming a one piece harness. The inner diameter of said transparent tubular section is 0.020 larger than the outside diameter of said Chemi-luminescent light stick. The reason for this is to allow easy insertion and removal of said light stick, however the said Chemi-luminescent light stick (FIG. 1)20, when positioned inside said tubular section, stays frictionally engaged when the harness is stretched around a playball as illustrated in FIG. 1.

Figure 2:
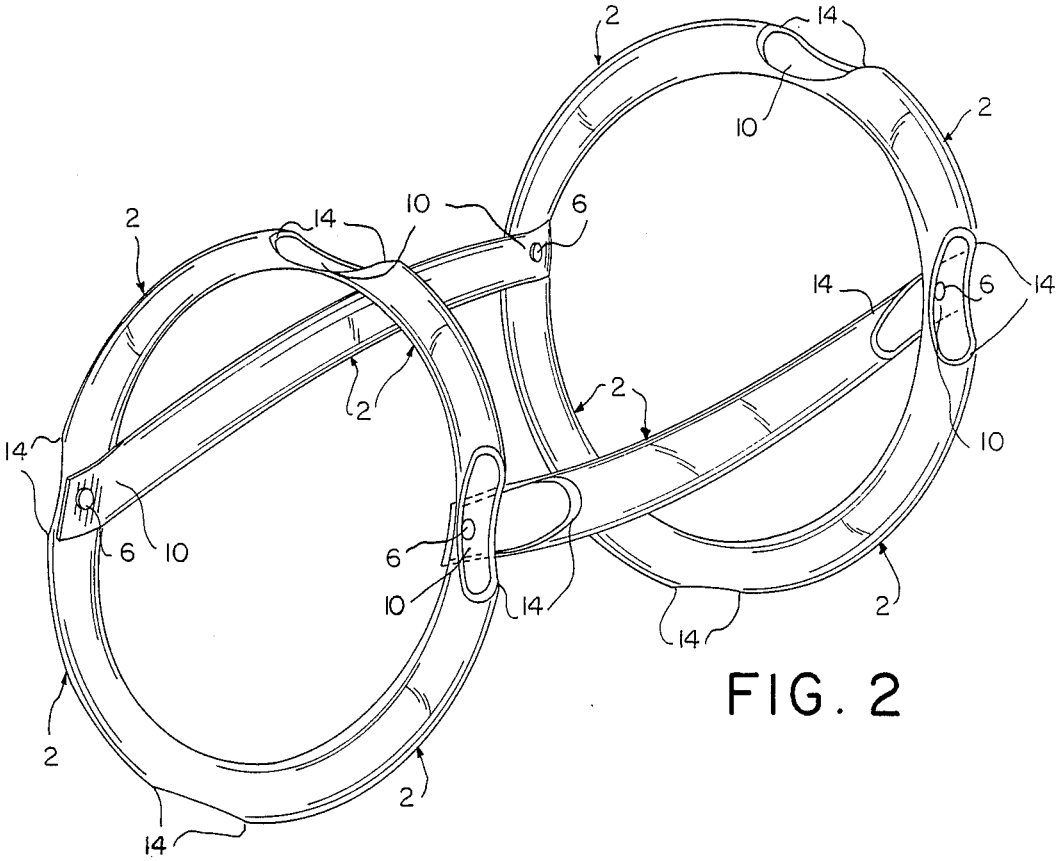
FIG. 2 is a perspective view of a harness using 10 transparent tubular sections.
Figure 8:
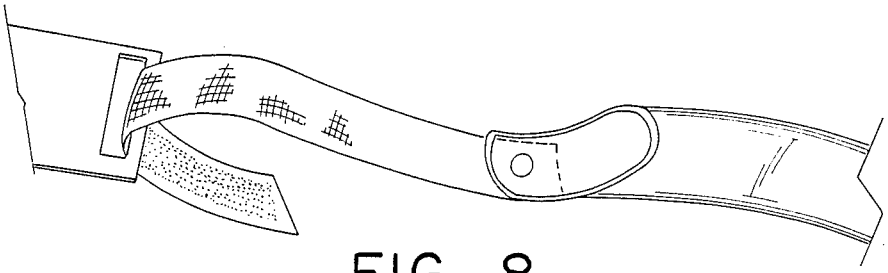
FIG. 8 is a perspective view of an imbodiment using a quick-release VELCRO fastening.
Figure 9:
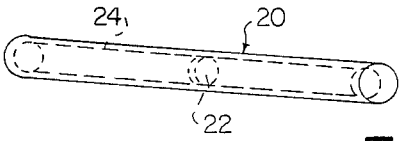
FIG. 9 is a perspective view of a Chemi-luminescent light stick.

The Chemi-luminescent light sticks (FIG. 9)20 are made by Cyanamid, U.S. Pat. Nos. 3,597,362 and 3,539,794 and are in the form of a closed tube 24 containing two liquid chemicals, separated by a frangible divider. 22 The tube, while generally rigid, may be sent sufficiently to break the divider, permitting the chemicals to mix and thereby react to produce Chemi-luminescent light. The said light sticks, 20 currently being used for the football light strap, are 3.000 in. in length with an outside diameter of 0.310 and weighing approximately less than 3 grams. While the above description contains many specificities, these should not be construed as limitations on the scope of the invention, but rather as an exemplification of one preferred embodiment thereof. Many other variables are possible, for example:

1. Using quick release attachment means to facilitate use, such as a VELCRO fastening device as illustrated in FIG. 8
2. Designing a harness to hold flat or square Chemi-luminescent light sticks.

Accordingly, the scope of the invention should be determined not by the embodiment illustrated, but by the appended claims and their legal equivalents.

I claim:

1. A harness for the attachment of lights to a play piece, comprising elongated means to encompass said play piece in multiple directions, a transparent tubular section within said elongated means along one of said directions, and light means adapted to be frictionally engaged within said tubular sections, said light means adapted to be activated by bending, snapping and shaking.

2. A harness in accordance with claim 1, in which said transparent tubular section comprises a section of tubing base cut obliguely at each end to define an opening and a fastening tab.

3. A harness in accordance with claim 1, in which said light means are chemi-luminescent light sticks.

4. A harness in accordance with claim 1, in which said elongated means include a quick-release section.

5. A harness in accordance with claim 1, in which said elongated means include an adjustable VELCRO fastening.

6. A harness in accordance with claim 1, in which said light means can vary in numerous sizes.

7. A harness in accordance with claim 1, in which the diameter of said transparent tubular section can vary in numerous sizes.

8. A harness in accordance with claim 1 in which said play piece consists of an official size football, conventional size foam football, official size volleyball, or whiffle ball.

* * * * *